United States Patent [19]

Combis

[11] 4,086,669

[45] May 2, 1978

[54] FOOT BATH

[76] Inventor: Christofalo C. Combis, 164-30 77th Rd., Flushing, N.Y. 11363

[21] Appl. No.: 760,158

[22] Filed: Jan. 17, 1977

[51] Int. Cl.[2] ..... A47K 3/022

[52] U.S. Cl. ..... 4/182; 4/172

[58] Field of Search ..... 4/182, 180, 172.19, 4/172, 173, 145, 146; 128/166

[56] References Cited

U.S. PATENT DOCUMENTS

| | | | |
|---|---|---|---|
| 1,685,969 | 10/1928 | Vietti | 4/182 UX |
| 3,001,208 | 9/1961 | Rosoff | 4/182 |
| 3,483,863 | 12/1969 | De Vane | 4/182 X |

*Primary Examiner*—Henry K. Artis
*Attorney, Agent, or Firm*—Robert D. Farkas

[57] ABSTRACT

A foot bath for use in conjunction with a swimming pool or the like which includes an open-ended pan having an open-ended liquid storage chamber dimensioned to accommodate a human foot when inserted therein, a chemical container forming a chemical storage chamber therein, means for communicating water at a controlled rate from the swimming pool to the chemical storage chamber of the chemical container, and metered communicating means for communicating a predetermined quantity of the liquid within the chemical container to the storage chamber of the open-ended pan.

7 Claims, 4 Drawing Figures

FOOT BATH

BACKGROUND OF THE INVENTION

1. Field of the Invention

The present invention relates to foot baths, and more particularly, to a foot bath for use by swimmers in conjunction with a swimming pool.

2. Description of the Prior Art

The desirability of cleansing the feet of swimmers prior to their entry into a swimming pool is well known. This foot washing prevents the inadvertent tracking of debris into the swimming pool and promotes proper hygiene in regard to athlete's foot or the like.

Presently, a shallow pan which is filled with water and a chemical such as an anti-bacterial agent is used for foot cleansing. The filling of the pan with water and chemicals is very bothersome as well as time consuming, as the pan must be refilled periodically as the water and chemical solution is depleted. In addition, when granulated chemicals are used, special care must be exercised to assure the complete disolvement of the chemicals as undisolved chemicals may lead to skin irritation as a result of their concentrated strength.

The present invention overcomes the problems associated with the prior art by providing a foot bath for use in conjunction with a swimming pool or the like which may be quickly and easily filled with chemicals and water.

SUMMARY OF THE INVENTION

Therefore, a primary object of the present invention is to provide a foot bath for use in conjunction with a swimming pool or the like.

A further object of the present invention is to provide a foot bath which is easily and quickly filled with water.

A still further object is to provide a foot bath which dispenses chemicals at a controlled rate.

Another object is to provide a foot bath which is readily adaptable for use with a variety of different types and sizes of above ground pools.

Still another object is to provide a foot bath which is simple in design, inexpensive to manufacture, and durable.

These objects, as well as further objects and advantages, of the present invention will become readily apparent after reading the description of a non-limiting illustrative embodiment and the accompanying drawing.

According to the principles of the present invention, a foot bath for use in conjunction with a swimming pool or the like includes an open-ended pan for resting on a supporting surface, the pan including a plurality of side walls and a base, the sidewalls fixedly secured to the base thereby forming an open-ended liquid storage chamber, the storage chamber accommodating the insertion of a human foot therein through the open-end thereof; a chemical container forming a chemical storage chamber therein, the container having a filling aperture located therein for communicating liquids to the chemical storage chamber thereof; means for communicating water at a controlled rate from the swimming pool into the chemical storage chamber of the chemical container; and metered communicating means for communicating a predetermined quantity of the liquid within the chemical storage chamber to the open-ended liquid storage chamber of the open-ended pan.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
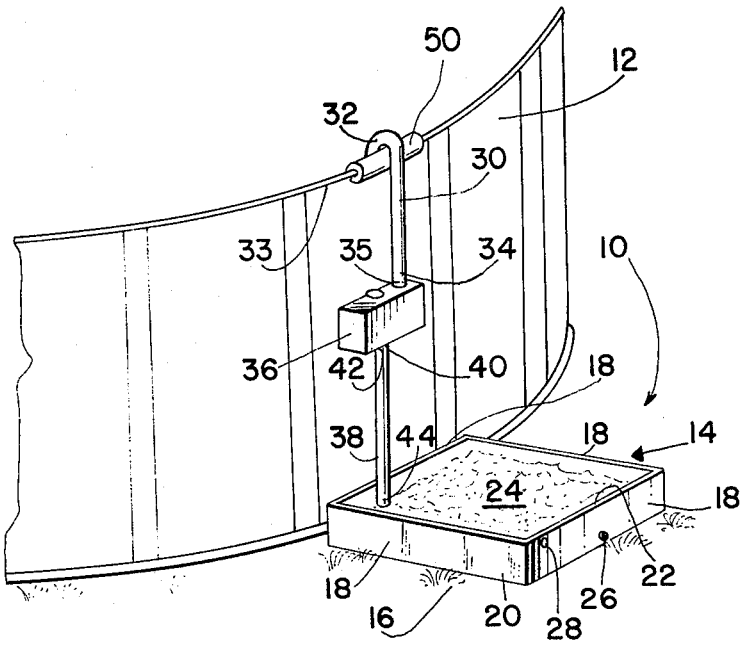
FIG. 1 is a perspective view of the preferred embodiment incorporating the principles of the present invention in use in conjunction with a swimming pool.

Referring now to the figures, and more particularly to FIG. 1, there is illustrated therein a foot bath 10 which is in use in conjunction with an above ground swimming pool 12. The foot bath 10 includes an open-ended pan 14 which rests on the earth 16. The pan 14 includes a plurality of sidewalls 18 and a base portion 20 all secured together to form a substantially rectangular structure which provides an open-ended liquid storage chamber 22. The open-ended liquid storage chamber 22 is illustrated filled with water 24 and can be drained by the removal of a drain plug 26 disposed in the sidewall 18. An overflow plug 28 is also provided in the sidewall 18. The open-ended liquid storage chamber 22 is dimensioned to accommodate a pair of human feet when placed therein.

Figure 3:
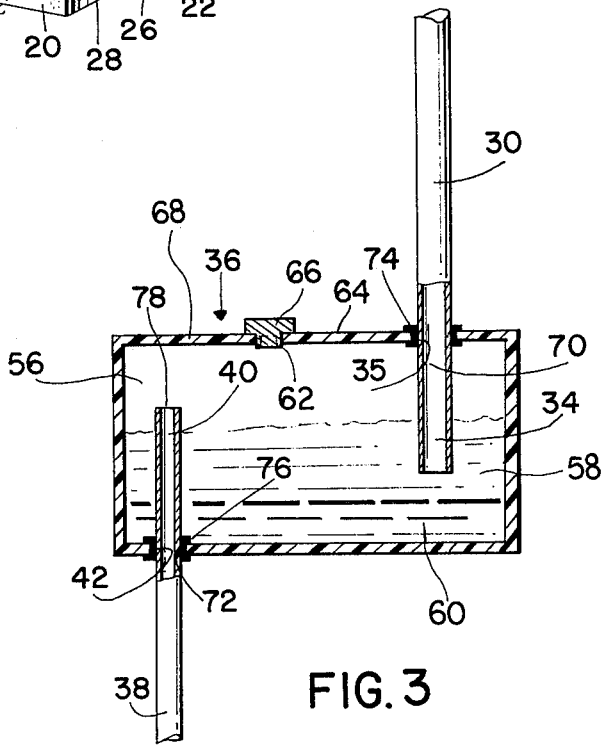
FIG. 3 is an enlarged cross-sectional side view of the chemical container of the present invention.

A rigid hollow open-ended siphon tube 30 is hooked on a first end 32 thereof over the sidewall 33 of the pool 12. The second end 34 of the siphon tube 30 is inserted in a siphon aperture 35 located in a chemical container 36 and is fixedly secured thereto as further illustrated in FIG. 3. A delivery tube 38 is inserted on a first free end 40 thereof through a delivery aperture 42 located in the chemical container as illustrated in FIG. 3. The second free end 44 of the delivery tube 38 is disposed within the liquid storage chamber 22 of the open-ended pan 14.

Figure 2:
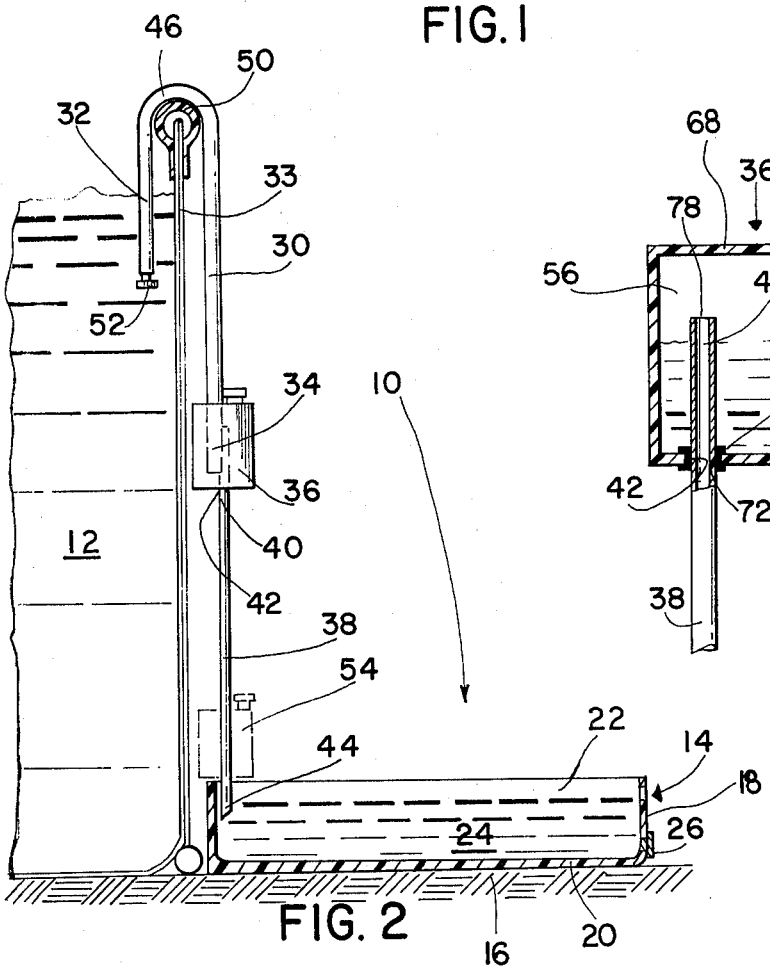
FIG. 2 is a side view of the preferred embodiment.

FIG. 2 illustrates the foot bath 14 in use with the swimming pool 12. The portion 46 of the siphon tube 30 adjacent to the first end 32 thereof is substantially "U" shaped and engages the wall 33 of the pool 12. A cushion 50 is illustrated under the "U" shaped portion 46 of the siphon tube 30. A hollow elongated plug 52 is slideably disposed and frictionally retained within the first end 32 of the siphon tube 30 and is used to control the flow of water therethrough as further described in FIG. 4. Although the chemical container 36 is illustrated in a position midway between the edges of the pool sidewall 33 it may also be positioned adjacent to the open-ended pan 14 shown by the phantom lines 54.

FIG. 3 illustrates a sectional view of the chemical container 36 which forms a chemical storage chamber 56 therein. The chemical storage chamber 56 is filled with water 58 which has been siphoned therein through the siphon tube 30 and a granular chemical 60. The granular chemical 60 may be an anti-bacterial agent or the like or may be replaced with a chemical in a liquid form. A filling aperture 62 is located in the upper wall 64 of the chemical container 36 and is provided to permit the communication of chemicals into the chemical storage chamber 56. A cover element 66 is provided to seal the filling aperture 62 and threadably engages the walls 68 thereof. The portions 70 and 72, respectively, adjacent to the ends 34 and 40 of the siphon tube 30 and the delivery tube 38 are secured, respectively, to the siphon aperture 35 and the delivery aperture 42 by a pair of rubber gaskets 74 and 76. The portion 72 of the delivery tube 38 extends upwardly into the chemical storage chamber 56 a distance determined at the time of manufacture. When the water 58 reaches a level above the free edge 78 of the delivery tube 38, the water 58 is communicated to the liquid storage chamber 22 of the open-ended pan 14.

Figure 4:
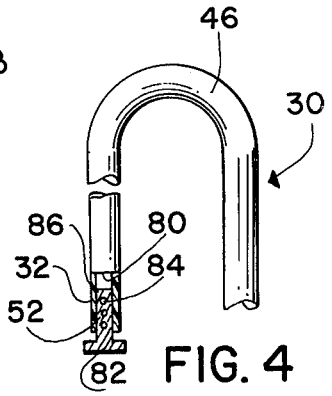
FIG. 4 is a fragmentary side view of the siphon tube of the present invention partially broken away.

FIG. 4 illustrates the substantially "U" shaped portion 46 of the siphon tube 30 and the hollow elongated plug 52 inserted in the first end 32 thereof. The plug 52 has an open end 80 and a closed end 82. A plurality of apertures 84 are disposed in the sidewall 86 of the plug 52. As the plug 52 is slid out of the siphon tube 30 the apertures 84 are exposed. The more apertures 84 exposed the greater the flow of water through the siphon tube 30.

In use, the siphon tube 30 is filled and hung in the pool 12. The chemical storage chamber 56 is filled with a suitable chemical. The plug 52 is then slid partially out of the siphon tube 30 causing a flow of pool water into the chemical storage chamber 56. The water mixes with the chemicals and flows through the delivery tube 38 into the open-ended pan 14 when the level of water and chemicals reach the upper free edge 78 of the delivery tube 38. When the pan 14 is filled to a desired level the plug 52 is slid back into the siphon tube 30 thereby stopping the flow of water.

Therefore, a primary advantage of the present invention is to provide a foot bath for use in conjunction with a swimming pool or the like.

A further advantage of the present invention is to provide a foot bath which is easily and quickly filled with water.

A still further advantage is to provide a foot bath which dispenses chemicals at a controlled rate.

Another advantage is to provide a foot bath which is readily adaptable for use with a variety of different types and sizes of above ground pools.

Still another advantage is to provide a foot bath which is simple in design, inexpensive to manufacture, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A foot bath for use in conjunction with a swimming pool comprising:

an open-ended pan for resting on a supporting surface, said pan including a plurality of sidewalls and a base, said sidewalls fixedly secured to said base thereby forming an open-ended liquid storage chamber, said storage chamber accommodating the insertion of a human foot therein through said open-end thereof;

a chemical container forming a chemical storage chamber therein, said container having a filling aperture located therein for communicating liquids to said chemical storage chamber thereof;

means for communicating water at a controlled rate from said swimming pool into said chemical storage chamber of said chemical container; and metered communicating means for communicating a predetermined quantity of said liquid within said chemical storage chamber to said open-ended liquid storage chamber of said open-ended pan.

2. A foot bath as claimed in claim 1, wherein said communicating means comprises a hollow rigid open-ended siphon tube, a first end of said tube for insertion in said water disposed in said pool, the second end of said siphon tube for insertion into a siphon aperture located in said chemical container, said siphon tube communicating said water into said chemical container, and means for controlling the rate of flow of said water.

3. A foot bath as claimed in claim 2, wherein said means for controlling the rate of flow of said water comprises a hollow elongated plug having an open end and a closed end, said plug for insertion in and for frictionally slideably engaging said first end of said siphon tube, said hollow elongated plug having a plurality of intake apertures located therein, the sliding of said elongated plug out of said siphon tube exposing said apertures and thereby regulating the flow of said water.

4. A foot bath as claimed in claim 2, wherein the portion of said hollow rigid open-ended siphon tube adjacent said first end thereof is substantially "U" shaped, said "U" shaped portion for engaging and hanging on the wall of said pool.

5. A foot bath as claimed in claim 1, wherein said metered communicating means comprises a hollow delivery tube having a first free end and a second free end, said first free end for insertion through a delivery aperture located in the lowermost surface of said chemical container, the portion of said delivery tube adjacent said first free end thereof extending upwardly a predetermined distance into said chemical storage chamber of said chemical container, said liquid within said chemical storage chamber entering said first free end of said delivery tube when reaching a level above the uppermost surface thereof, said portion of said delivery tube being fixedly secured to said chemical container, said second free end of said delivery tube disposed within said liquid storage chamber of said open-ended pan.

6. A foot bath as claimed in claim 1, further comprising a cover element dimensioned to threadably engage and cover said filling aperture located in said chemical container.

7. A foot bath as claimed in claim 1, further comprising a drain aperture and a plug therefor located in a said sidewall of said open-ended pan, said drain plug being adjacent said base.

* * * * *